US011589727B2

(12) United States Patent
Bianchi et al.

(10) Patent No.: US 11,589,727 B2
(45) Date of Patent: Feb. 28, 2023

(54) WASHING AGENT DISPENSER AND MOUNTING METHOD

(71) Applicant: ELTEK S.p.A., Casale Monferrato (IT)

(72) Inventors: Marco Bianchi, Casale Monferrato (IT); Marta Armato, Casale Monferrato (IT); Paolo Savini, Casale Monferrato (IT)

(73) Assignee: ELTEK S.p.A., Casale Monferrato (IT)

( * ) Notice: Subject to any disclaimer, the term of this patent is extended or adjusted under 35 U.S.C. 154(b) by 93 days.

(21) Appl. No.: 17/254,034

(22) PCT Filed: Jun. 17, 2019

(86) PCT No.: PCT/IB2019/055038
§ 371 (c)(1),
(2) Date: Dec. 18, 2020

(87) PCT Pub. No.: WO2019/243997
PCT Pub. Date: Dec. 26, 2019

(65) Prior Publication Data

US 2021/0361141 A1 Nov. 25, 2021

(30) Foreign Application Priority Data

Jun. 19, 2018 (IT) ..... 102018000006469

(51) Int. Cl.
*A47L 15/42* (2006.01)
*A47L 15/44* (2006.01)

(52) U.S. Cl.
CPC ..... *A47L 15/4409* (2013.01); *A47L 15/4246* (2013.01); *A47L 15/4251* (2013.01); *A47L 2501/07* (2013.01)

(58) Field of Classification Search
None
See application file for complete search history.

(56) References Cited

FOREIGN PATENT DOCUMENTS

CN 105 534 460 5/2016
CN 207 306 639 5/2018
(Continued)

OTHER PUBLICATIONS

International Search Report and Written Opinion of ISA for PCT/IB2019/055038 dated Aug. 27, 2019, 14 pages.

*Primary Examiner* — Levon J Shahinian
(74) *Attorney, Agent, or Firm* — Nixon & Vanderhye P.C.

(57) ABSTRACT

A washing-agent dispenser designed for being mounted at a through opening (A) of a tub wall (5) of a dishwasher comprises:—a dispenser body (11), having a rear part (11') and a front part (11"); —a perimetral gasket (30) mounted in a corresponding seat (S) of the dispenser body (11) and prearranged for exerting a sealing action with respect to a mounting side (5*a*) of the tub wall (5); —a frame (40) having a substantially annular shape, defining a central passage (B) through which the rear part (11') of the dispenser body (11) is insertable. The frame (40) has at least one of the following:—first coupling means (41), which can be coupled to corresponding second coupling means (16) provided in the dispenser body (11), the first coupling means (41) and the second coupling means (16) being configured for fixing of the dispenser body (11) at the through opening (A) of the tub wall (5), in a condition of at least partial compression of the perimetral gasket (30) for exerting thereby a sealing action between the dispenser body (11) and the mounting side (5*a*) of the tub wall (5); and—reinforcement means (42, 43), prearranged for countering possible deformation or yielding of the tub wall (5) at least in an area thereof that circumscribes the corresponding through opening (A).

20 Claims, 12 Drawing Sheets

(56) References Cited

FOREIGN PATENT DOCUMENTS

| | | |
|---|---|---|
| DE | 100 14 146 | 9/2001 |
| EP | 0 556 787 | 8/1993 |
| JP | S50-61660 | 6/1975 |

Fig. 4
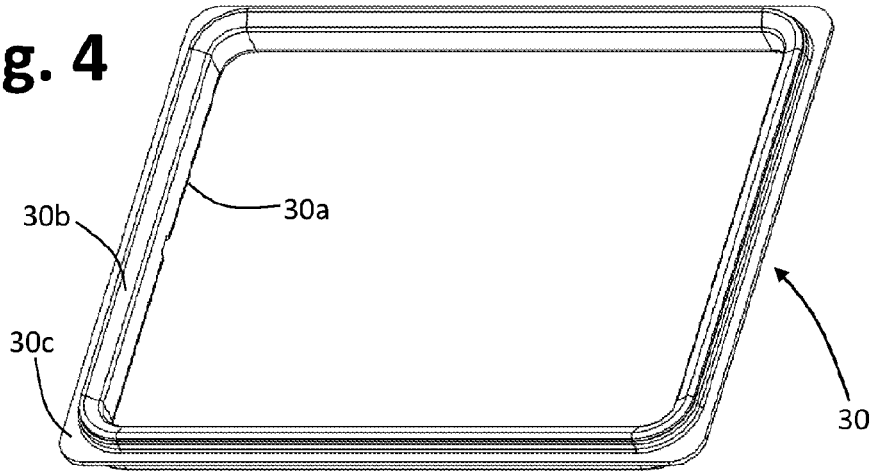
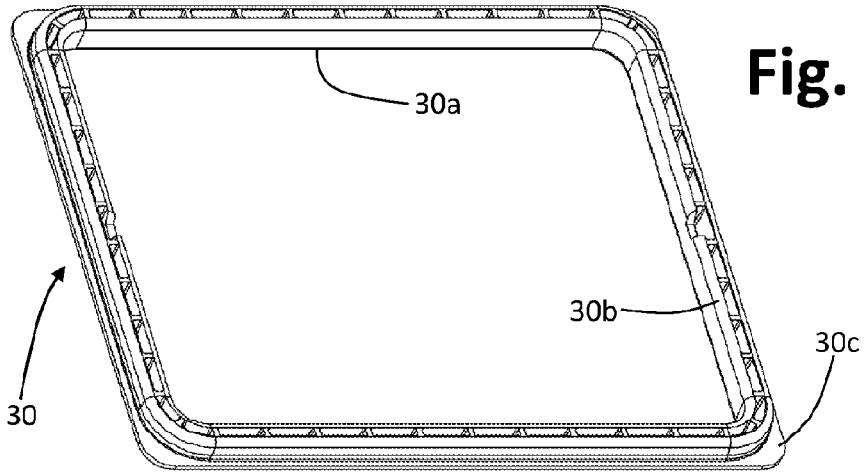
Fig. 5
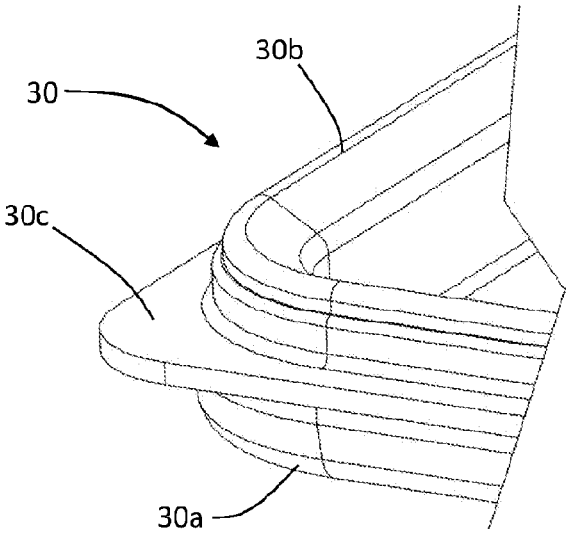
Fig. 6

Fig. 22
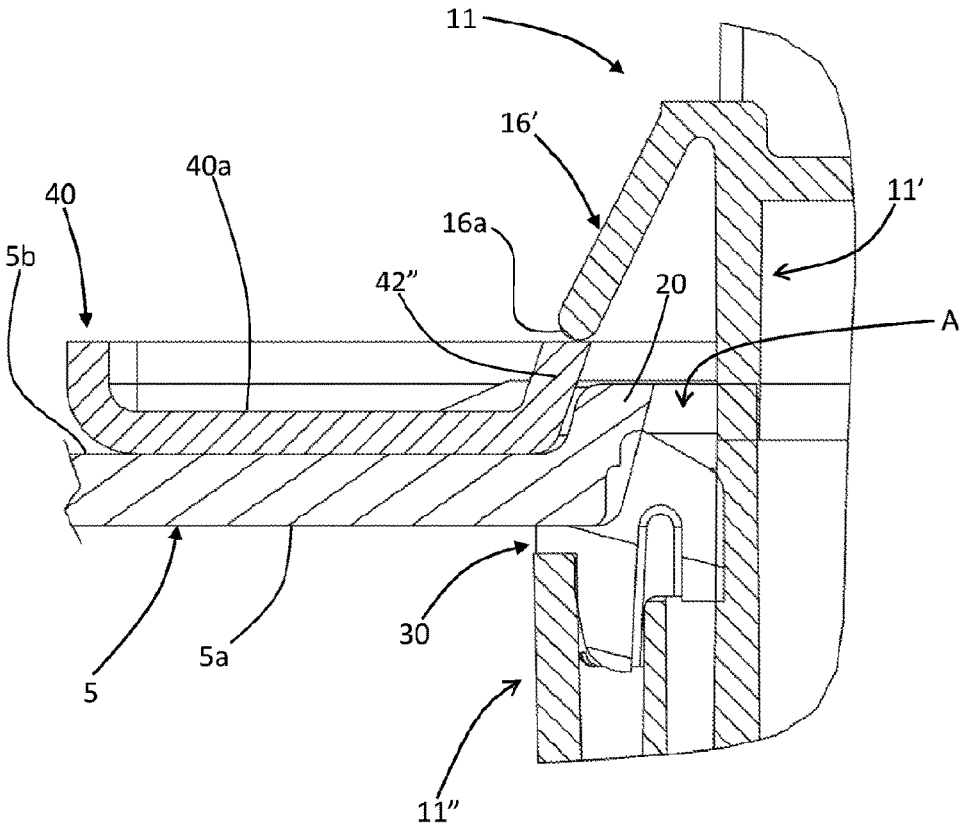
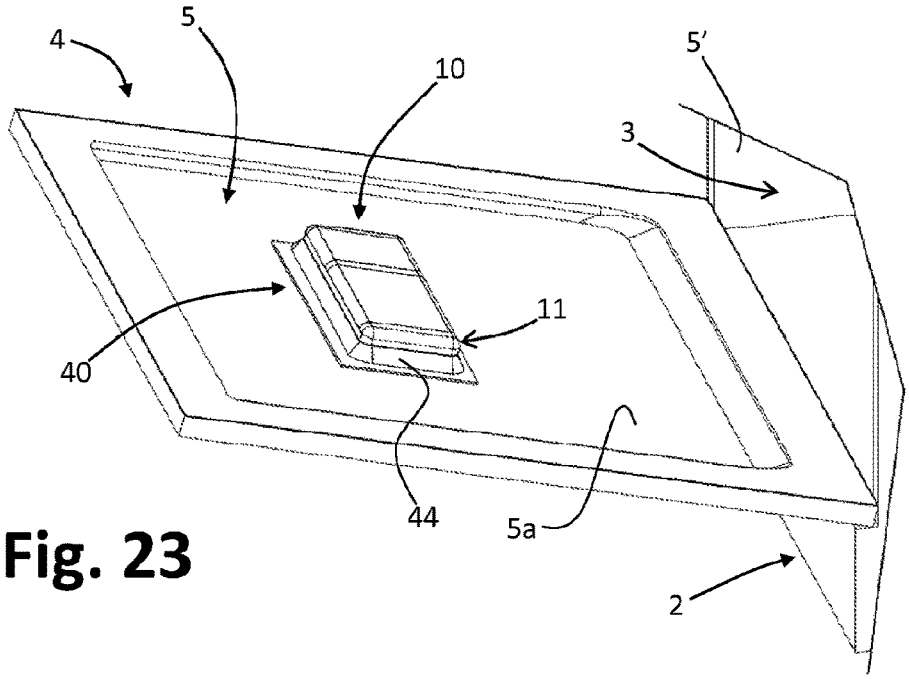
Fig. 23

WASHING AGENT DISPENSER AND MOUNTING METHOD

This application is the U.S. national phase of International Application No. PCT/IB2019/055038 filed Jun. 17, 2019 which designated the U.S. and claims priority to IT Patent Application No. 102018000006469 filed Jun. 19, 2018, the entire contents of each of which are hereby incorporated by reference.

FIELD OF THE INVENTION

The present invention relates to dispensers of washing agents for household dish-washing machines, and more in particular to dispensers designed to be mounted at one of the walls that define a washtub of a dish-washing machine, such as an inner wall or inner door panel of a front door that delimits the tub of the machine at the front. The invention has been developed with particular reference to dispensers designed to be mounted at a wall of the tub that is made at least in part of a plastic material.

PRIOR ART

As is known, household dish-washing machines are usually provided with a front door, the structure of which includes a wall that, when the door is closed, delimits the washtub of the machine at the front. This wall is generally defined as "inner door panel".

In the majority of known solutions, the washing-agent dispenser of the dishwasher is fixed at a through opening of the inner door panel so that a front portion thereof is set facing the inside of the tub, to enable delivery of the washing agents. In other cases, the washing-agent dispenser is, instead, fixed at a through opening of one of the fixed parts of the tub, such as a side wall thereof. Hence, in what follows, by the term "mounting wall" will be meant the wall at which the dispenser is mounted, whether it is the "movable" wall of the tub formed by the inner door panel or else one of the fixed walls of the tub, for example a side wall.

Between the aforesaid front portion of the dispenser and the front side of the mounting wall a sealing gasket is usually provided.

The mounting wall is traditionally a wall made of metal material, generally stainless steel, even though in recent times increasingly widespread is the production of washtubs with walls, for example inner door panels, made at least in part of a polymer or plastic material, for example in the form of a shell of thermoplastic material. The aim of this is in particular to reduce the costs and/or to obtain more easily complex shapes for the washtub of the machine.

In view of the fact that the mounting wall is directly exposed to the washing environment, it may occasionally be subject to deformations or expansions, in particular during steps of an operating cycle of the dishwasher that involve heating, such as washing steps or rinsing steps carried out with heated liquid inside the tub. The problem may be present in particular during execution of washing programs referred to as "strong programs", which are distinguished, inter alia, by a relatively high temperature of the treatment liquid.

The aforesaid deformations or expansions could lead to leakages around the aforesaid gasket, which surrounds the through opening of the mounting wall at which the dispenser is mounted. For this reason, fixing of the dispenser on the mounting wall is carried out in a firm way and, for this purpose, gaskets are preferably used devised for exerting a sealing action of an axial type between the body of the dispenser and the front side of the mounting wall. The body of the dispenser is typically secured to the mounting wall using a series of threaded members, arranged and secured so as to pack the gasket axially between the body of the dispenser and the mounting wall, at the same time strengthening the sealing area. This type of fixing it is rather laborious, increasing the times and complexity of production of the dishwasher.

AIM AND SUMMARY OF THE INVENTION

The present invention has basically the aim of overcoming the drawbacks of the prior art referred to above, via a washing-agent dispenser that is inexpensive to produce, but at the same time able to be mounted in a simple, fast, and reliable way on the wall of a tub made at least in part of a plastic or polymeric material. The above and other aims still, which will emerge more clearly hereinafter, are achieved according to the present invention by a washing-agent dispenser having the characteristics specified in the annexed claims. Likewise forming a subject of the invention is a household dish-washing machine that uses such a dispenser, as well as a method for installing such a dispenser.

The claims form an integral part of the technical teaching provided herein in relation to the invention.

BRIEF DESCRIPTION OF THE DRAWINGS

Further aims, characteristics, and advantages of the invention will emerge clearly from the ensuing detailed description, with reference to the annexed drawings, which are provided purely by way of non-limiting example and in which:

FIGS. 4 and 5 are schematic perspective views, from different angles, of a sealing gasket that can be used in a dispenser according to possible embodiments of the invention;

FIGS. 6 and 7 are partial and schematic views of portions of the gasket of FIGS. 4-5;

FIG. 22 is a view similar to that of FIG. 21, regarding a variant of the invention; and FIG. 23 is a partial and schematic perspective view of a dish-washing machine according to a possible further embodiment.

DESCRIPTION OF PREFERRED EMBODIMENTS

Reference to "an embodiment" or "one embodiment" in the framework of the present description is intended to indicate that a particular configuration, structure, or characteristic described in relation to the embodiment is comprised in at least one embodiment. Hence, phrases such as "in an embodiment", "in one embodiment", "in various embodiments", and the like, that may be present in various points of this description do not necessarily refer to one and the same embodiment. Moreover, particular conformations, structures, or characteristics defined in the framework of the present description may be combined in any adequate way in one or more embodiments, even different from the ones represented. The reference numbers and spatial references (such as "top", "bottom", "upper", "lower", etc.) used herein are provided merely for convenience and hence do not define the sphere of protection or the scope of the embodiments. The same reference numbers are used in the figures to designate elements that are similar or technically equivalent to one another.

Figure 1:
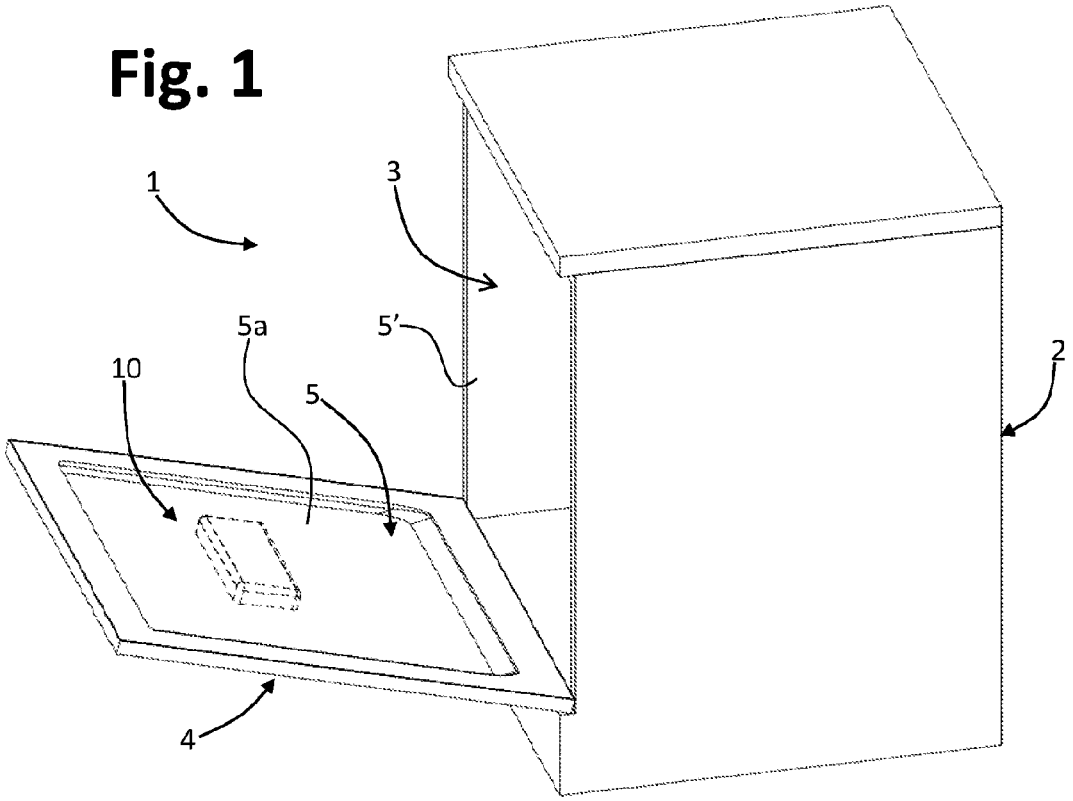
FIG. 1 is a schematic perspective view of a dish-washing machine, with a front door in the open position.

Represented schematically in FIG. 1 is a dish-washing machine, designated as a whole by 1, equipped with a washing-agent dispenser provided according to the invention. In the case exemplified, the dishwasher 1 has a cabinet or structure 2 defining inside it a washing tub or chamber 3. Designated as a whole by 4 is a front door of the machine 1, associated to the cabinet 2 so that it can be moved between an opening position and a closing position. In various embodiments, such as the one exemplified, the door 4 can be moved angularly between the aforesaid positions, preferably but not necessarily about a substantially horizontal axis. The dishwasher 1 could, however, be of some other type, for example with at least one translating or sliding door: in some dishwashers, in fact, the loading door is not of the type that can be tipped down, but slides linearly along purposely provided guides, for example as described in FR-A-2,674,426. In other solutions still, the dishwasher may have a rack for containing the dishes to be washed configured as a sliding drawer, the front wall of which constitutes in effect a door of the machine.

The inner face of the door 4 comprises a tub wall 5, referred to hereinafter also as "inner door panel", having an outer side 5*a* that constitutes the front surface of the washtub 3. The tub 3 is also delimited by a plurality of fixed tub walls, one of which is designated by 5', which typically comprise two side walls, a rear wall, an upper wall or roof, and a lower wall or bottom.

Mounted in the inner door panel 5, at a corresponding through opening, is a dispenser of washing agents, designated as a whole by 10 and represented only schematically in FIG. 1. In various embodiments, the inner door panel 5, or at least one part thereof, where the aforesaid through opening is defined, is made of plastic material, for example via injection moulding of a thermoplastic material. The machine 1 then comprises all the elements normally known for its operation, which are not relevant for the purposes of the present invention and hence will not be described herein.

The way in which the dispenser 10 is mounted on the inner door panel 5 is to be understood as being provided by way of example, in so far as the dispenser could be installed at a through opening of any of the walls of the tub 3, for example a stationary wall, such as the side wall designated by 5', or a movable wall, such as the wall 5 of a door (or of a movable drawer). Consequently, what is described hereinafter in relation to the installation of the dispenser 10 on the inner door panel 5 is to be understood as being provided by way of example also in the case where the dispenser 10 is mounted on any other wall of the tub 3, in particular a fixed wall thereof. The side defined herein as "outer side" of the mounting wall of the dispenser 10 (whether it is a movable wall 5 or a fixed wall 5') is the surface of the aforesaid wall facing the inside of the washtub of the machine, whereas the side defined as "inner side" is the surface of the same wall opposite to the outer side. The side defined herein as "mounting side" is the side of the tub wall (whether it is a movable wall 5 or a fixed wall 5') starting from which the dispenser body 11 is inserted through the corresponding through opening A.

Figure 2:
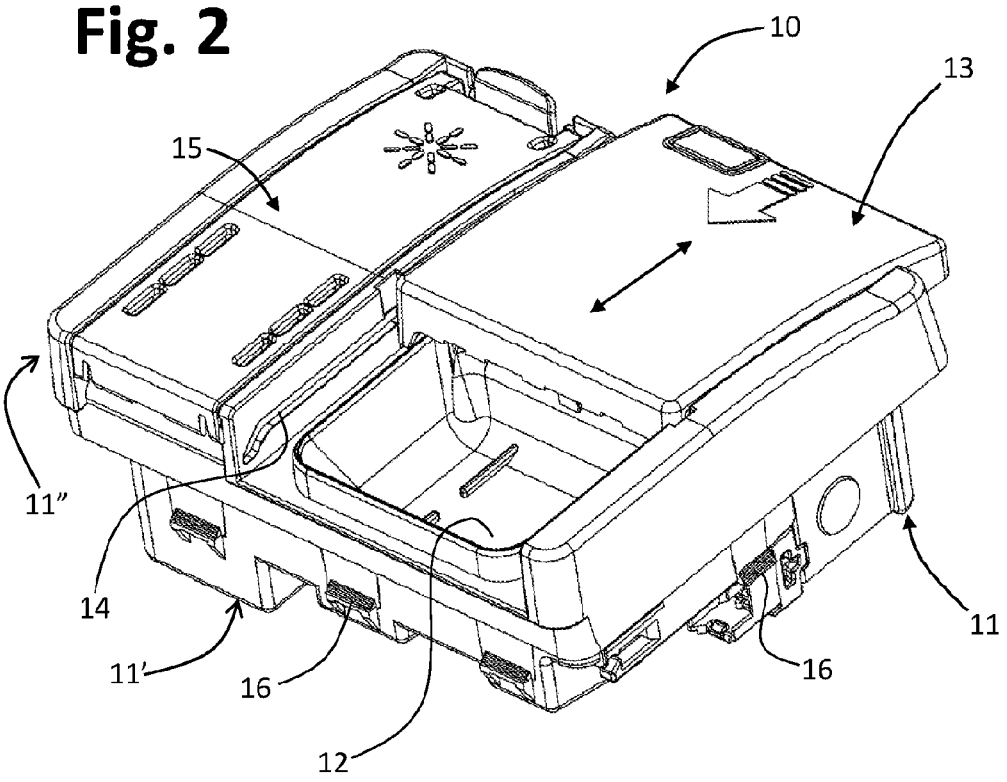
FIG. 2 is a schematic perspective view of a dispenser body of a dispenser according to possible embodiments of the invention.

With reference to FIG. 2, in various embodiments, the dispenser 10 comprises a dispenser body 11, which is preferably made at least in part of moulded thermoplastic material. Preferentially, the body 11 is made up of a number of pieces, for example moulded with thermoplastic material separately from one another and then joined together, for example via welding. Associated to the body 11 are various functional members, of a type in themselves known and hence not described, necessary for its operation (such as actuator means, a door and/or a plug, a system for engagement/release of a door, a valve for dosing a liquid washing agent, etc.).

In the example illustrated, the dispenser body 11 comprises a first part 11', which is designed to be at least in part inserted in a through opening of the wall 5 of the tub, and a second part 11", which is to project at least in part from the front or outer side 5*a* of the inner door panel 5; in what follows, for simplicity, the aforesaid body parts 11' and 11" will also be referred to as "rear part" and "front part", respectively.

In various embodiments, defined in the front of the body 11, i.e., the front part 11", is a receptacle 12 designed for containing a washing agent, such as a solid washing agent in the form of a powder or tablet (even though not ruled out is the possibility of it containing washing substances in some other form, such as a liquid or a gel). Constrained to the body 11, i.e., to the front part 11", in a position corresponding to the receptacle 12, is a door, designated as a whole by 13, comprising, for example, a door body obtained via moulding of thermoplastic material. The door 13 is mounted movable on the body part 11" so as to be able to move between a position for closing and a position for opening the receptacle 12. For this purpose, for example, the door 13 may be constrained relative to the dispenser body 11 via slide guides 14, and a suitable system for engagement/release of the door 13 may be associated to the body 11 itself, according to a technique in itself known.

In various embodiments, in addition or as an alternative to the delivery system including the receptacle 12 and the door 13, the dispenser 10 defines within the body 11 a reservoir for a liquid washing agent (for example, a rinsing aid), and associated to the body itself is a system for dosage and dispensing of the aforesaid liquid washing agent. With reference to the non-limiting example illustrated in FIG. 2, alongside the area where the receptacle 12 is defined, there is associated a lid 15, provided with a corresponding engagement/release device that can be operated manually. The lid 15 is preferably hinged to the front part 11" of the dispenser body 11 so as to turn about a generally horizontal axis, even though it may also be slidably mounted. The door 15 is designed to cover a corresponding area, where the mouth of the reservoir referred to above is located. In the same area subtended by the lid 15 there may be present an outlet opening forming part of the system for delivery of the liquid washing agent, and for this purpose the body of the lid 15 preferentially has openings or passages designed to enable outflow of the aforesaid liquid agent into the washtub 3 of the machine 1. The presence of two different systems for delivery of two different washing agents does not constitute an essential characteristic of the invention. The same applies as regards the embodiment exemplified of the above two delivery systems, which could in fact be obtained according to any other technique in itself known in the field.

Figure 3:
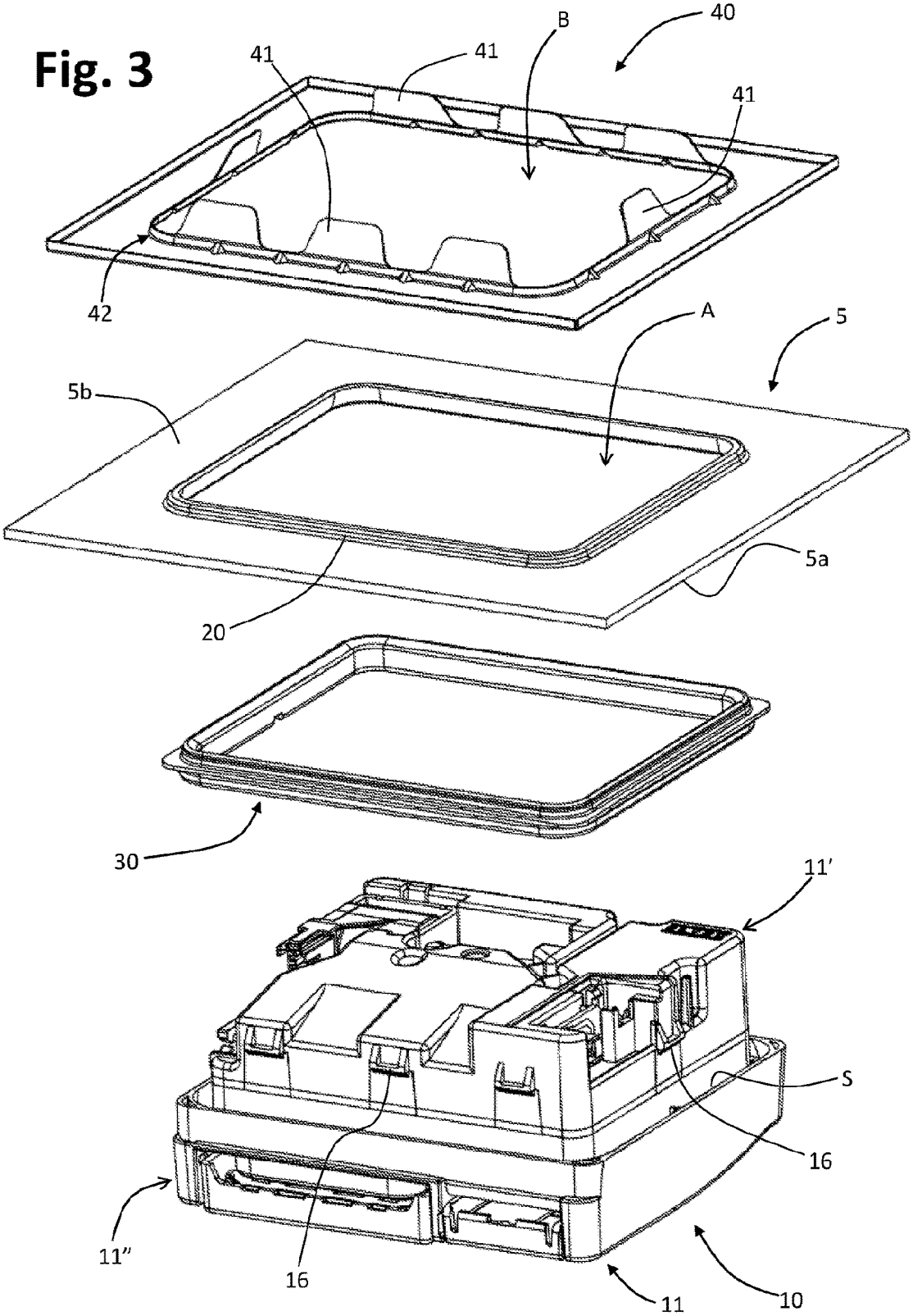
FIG. 3 is a schematic perspective view of a dispenser according to possible embodiments of the invention, in a step of installation thereof on a wall of the washtub of a dishwasher, the wall being represented only partially.

FIG. 3 shows a portion of the inner door panel 5, which, as has been said, is made at least in part of plastic material. In various embodiments, the plastic material in question is polypropylene, possibly containing a filler (for example, talcum), or else mastered polypropylene, or else a mixture of polypropylene and polyethylene. As has been said, the mounting wall 5 for the dispenser 10, however, be one of the fixed walls of the tub 3, for example the wall designated by 5' in FIG. 1.

The inner door panel 5 is provided with a through opening A, for mounting of the dispenser 10, as described hereinafter. In various embodiments, the opening A is substantially quadrangular, in particular substantially rectangular with rounded corners, but other shapes are not excluded.

In various preferential embodiments, the inner door panel 5 is shaped—for example, via injection moulding, or else via thermoforming, or else via blow moulding—so as to define integrally a perimetral lip or edge of the through opening A, this edge being designated by 20. The edge 20 is preferentially oriented towards the inside of the door 4 or, more in general, towards the outside of the tub of the dishwasher 1. The edge 20 rises from an inner side 5*b* of the inner door panel 5 (or other wall of the tub), such as the side opposite to the side 5*a* of the inner door panel 5 (or other wall) that delimits part of the tub 3 (see FIG. 1).

For the purposes of assembly, the dispenser body 11 is partially inserted into the opening A, starting from the mounting side 5*a* of the inner door panel 5, as may be seen in FIG. 3, in such a way that the rear part 11' of the body 11 is housed within the door 4, and the front part 11" of the body 11 projects at the front from the inner door panel 5, i.e., from its side 5*a* that is to face the inside of the washtub. Prior to the aforesaid insertion, an annular gasket, designated by 30, is mounted on the dispenser body 11 substantially at an area of transition between the two parts 11' and 11" of the body 11, and the dispenser body 11 is then fixed in position relative to the wall 5. The gasket 30 is preferentially made of an elastomer material, for example a silicone.

The front body part 11" preferably has larger perimetral dimensions both than the through opening A and than the rear body part 11' of the body 11: in this way, the body 11 can be fixed in position so that the gasket 30 is located in a condition of at least partial elastic compression in order to exert a sealing action, at least between the front body part 11" and the mounting side 5*a* of the wall 5.

Figure 7:
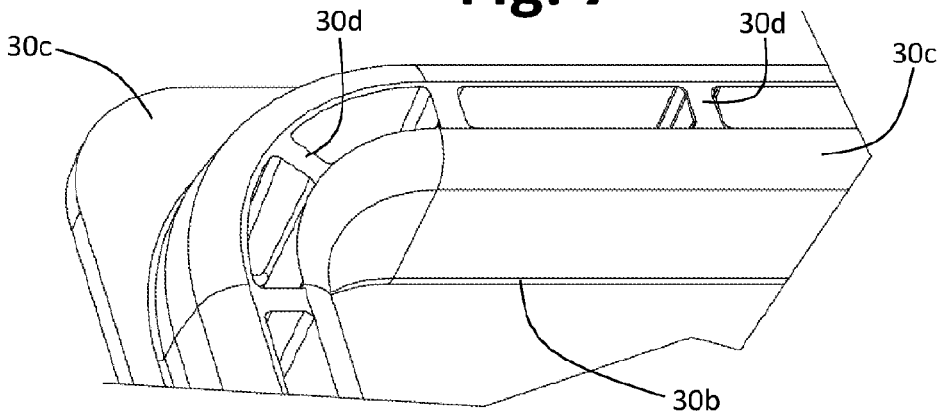

A possible embodiment of the gasket 30 is visible in FIGS. 4-5 and in the corresponding details of FIGS. 6-7. In the example, the gasket 30 has an annular shape, here generally quadrangular with rounded corners, in particular substantially rectangular. In various embodiments, the gasket 30 has a foot portion 30*a*, which is to be coupled in a corresponding seat S (FIG. 3) defined in the dispenser body 11, in the example substantially in the proximity of the transition or join between the two body parts 11' and 11". In various embodiments, the gasket 30 has a head portion 30*b*, which extends preferably from the side opposite to the portion 30*a* and is configured for providing a first seal, in particular a substantially radial seal, as described hereinafter. In various embodiments, the gasket 30 is shaped so as to exert also a sealing action of an axial type. In the example illustrated, the gasket 30 comprises for this purpose an intermediate portion 30*c*, for instance configured as a part projecting like a flange, towards the outside of the annular profile of the gasket itself. From the detail of FIG. 7, it may be noted how, in possible embodiments, the foot portion 30*a*, configured for fixing the gasket 30 in position, may be generally hollow; i.e., it may include two generally parallel annular walls, locally joined together by means of transverse stiffening walls 30*d*.

Fixing of the body 11 to the wall 5 is obtained by way of a frame, designated as a whole by 40 in FIG. 3. As may be seen also in FIG. 8, in various embodiments the frame 40 has a substantially annular shape in order to define a central passage B through which the rear part 11' of the dispenser body 11 can be inserted. Preferentially, the passage B has a substantially quadrangular profile, in particular substantially rectangular with rounded corners, but other shapes are not excluded.

In various preferential embodiments, the frame 40 is made of a single piece of metal material, for example via stamping or blanking from sheet metal. Preferentially, the frame 40 has a substantially plane base wall 40*a*, which is to rest against the inner side 5*b* of the inner door panel 5, the passage B being defined in the base wall 40*a*. In the example, the base wall 40*a* has a substantially rectangular continuous peripheral profile, but this does not constitute an essential characteristic.

In various preferential embodiments, the frame 40 is provided with first coupling or hooking elements, which can be coupled to corresponding second complementary coupling or hooking elements provided in the rear part 11' of the body 11. Preferentially, the aforesaid first and second coupling means are fast-coupling means, in particular with a mutual elastic or snap-action engagement. Once again preferably, the first coupling means are defined integrally by the body of the frame 40, i.e., in a single piece therewith. Likewise, preferably the second coupling means are defined integrally with a part of the dispenser body 11, i.e., in a single piece with this part. As may be noted, preferably, the first coupling means rise or project with respect to a general plane identified by the fame 40, in particular by the back thereof, and are substantially distributed along the perimeter of the central passage B.

Figure 8:
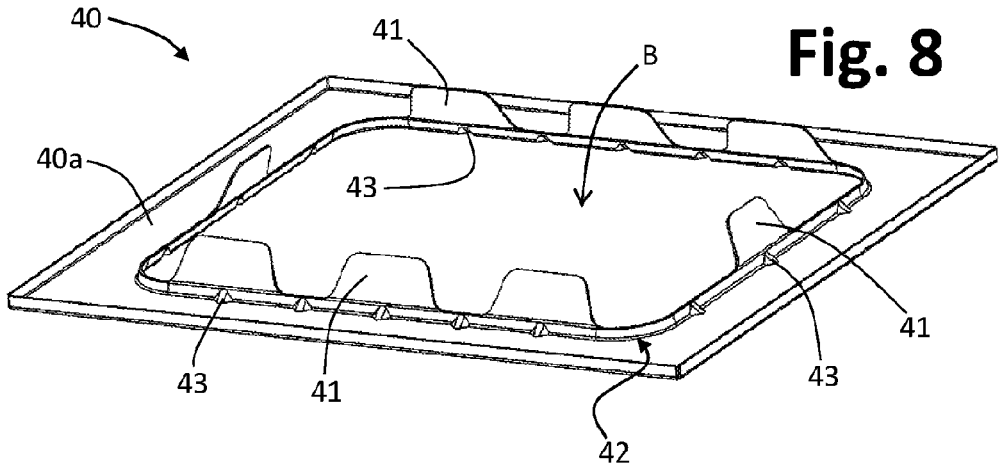
FIG. 8 is a schematic perspective view of a frame for a dispenser according to possible embodiments of the invention.

With reference in particular to FIGS. 3 and 8, in various embodiments, the aforesaid first coupling means comprise wings 41 that rise or project from the back of the frame 40, i.e., from the back of its base wall 40*a*, and that are substantially distributed along the perimeter of the central passage B. The wings 41 are preferentially at least slightly inclined towards the centre of the passage B and are elastically flexible.

On the other side, the aforesaid second coupling means are provided on the dispenser body 11, and in particular at the peripheral profile of its rear part 11'. In the example, the second coupling means comprise engagement teeth or reliefs 16, which project outwards from the side walls of the rear part 11' of the body 11, in positions substantially corresponding to those of the wings 41 of the frame 40.

For the purposes of fixing, as has been said, the part 11' is inserted through the opening A of the inner door panel 5, with the frame 40 that is set on the inner side 5*b* of the inner door panel itself, in particular with the base wall 40*a* of the frame resting on the aforesaid side 5*b*. In the course of insertion, the wings 41 manage to rest on the engagement reliefs 16, elastically bending outwards (with respect to the passage B of the frame 40), and then return elastically inwards, as far as the engagement position. Advantageously, the reliefs 16 can be shaped to include an inclined surface in order to favour, in the aforesaid step, sliding of the wings 41 on the reliefs themselves.

Figure 9:
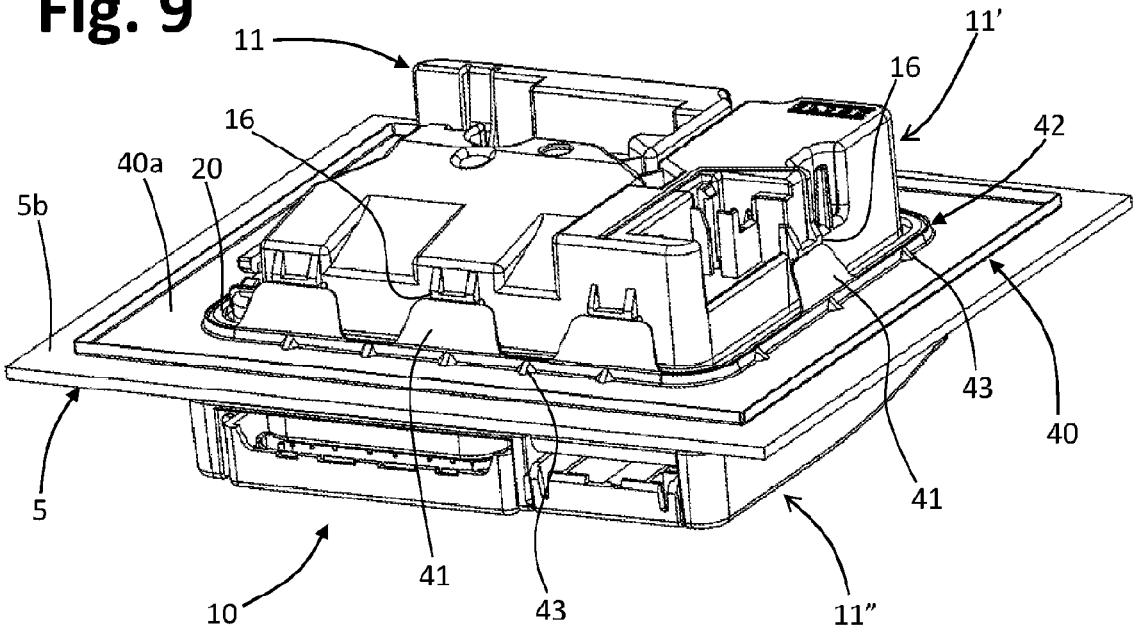
FIG. 9 is a partial and schematic perspective view of a dispenser according to possible embodiments of the invention, mounted on a wall of the washtub of a dishwasher.
Figure 10:
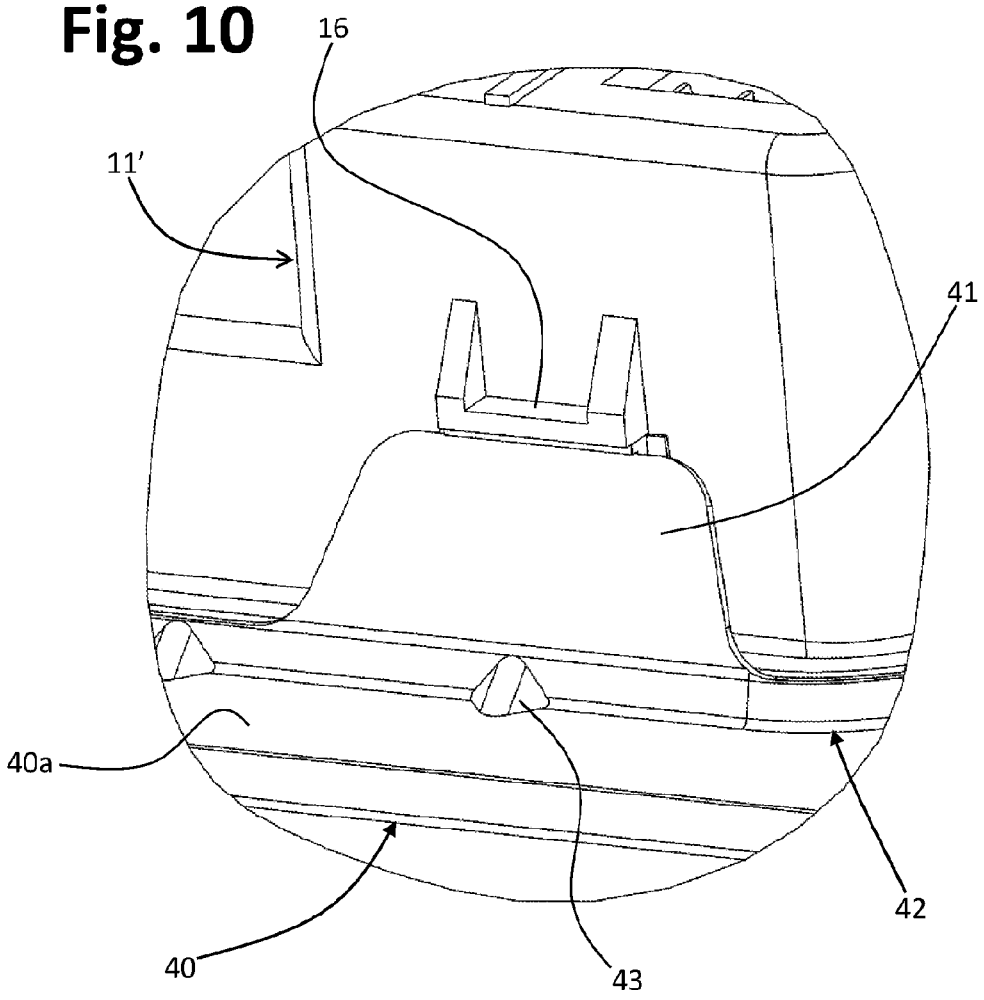
FIG. 10 is a detail of FIG. 9.
Figure 11:
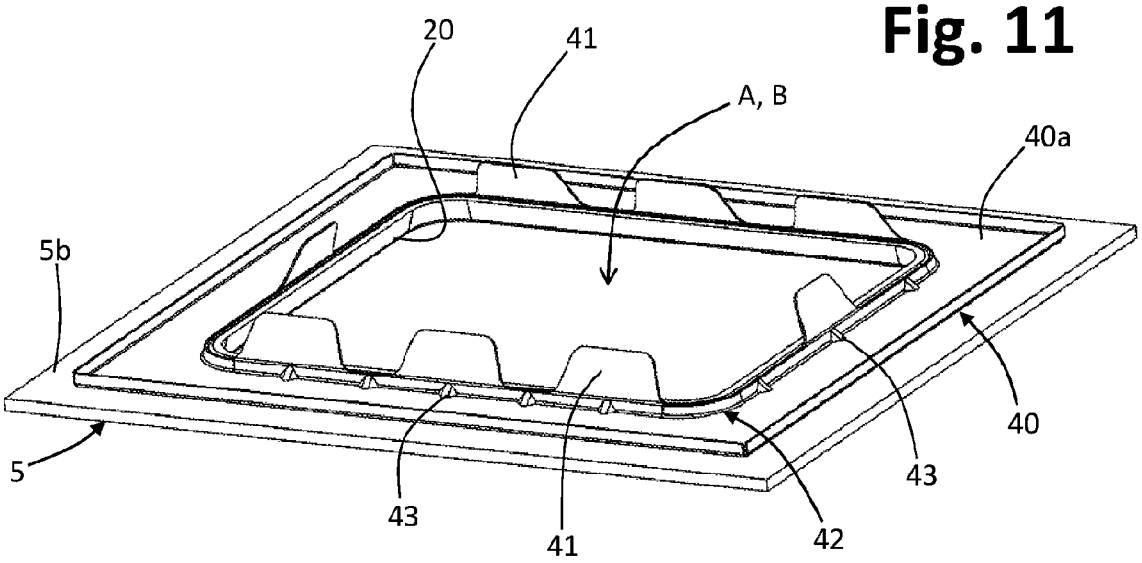
FIG. 11 is a schematic perspective view of a frame for a dispenser according to possible embodiments of the invention, associated to a wall of the washtub of a dishwasher.

Practically at the end of travel of insertion, the upper ends of the wings 41 overcome the profile of the engagement reliefs 16, bending again inwards (with respect to the passage B of the frame 40), substantially engaging by snap-action with the reliefs themselves, as may be noted in FIG. 9 and in the corresponding detail of FIG. 10, and thereby blocking the dispenser body 11 in position. The relative arrangement between the reliefs 16 and the wings 41, as well as the inclined arrangement of the latter, advantageously makes it possible to bring about self-centring of the body 11 relative to the frame 40. Engagement between the wings 41 and the reliefs 16 is preferably obtained in a condition of partial compression of the gasket 30, which in this way can exert or improve the necessary sealing action.

The frame 40 integrates reinforcement means, pre-arranged for countering possible deformations or failures of the inner door panel 5, at least in the area of the inner door panel that surrounds the corresponding through opening A designed for installation of the dispenser, in particular at an edge or lip—such as the one designated by 20—that surrounds the opening A in the inner door panel 5, on which the gasket 30 operates preferentially in a fluid-tight way. As may be noted, preferably the reinforcement means rise or project with respect to a general plane identified by the frame 40, in particular by the back thereof, and are in particular arranged or distributed along the perimeter of the central passage B.

For this purpose, in various preferred embodiments of the invention, the central passage B of the frame 40 is provided with an annular lip or reinforcement edge, designated by 42 for example in FIGS. 8-11. Preferentially, the edge 42 is a projecting edge that rises from the base wall 40*a* of the frame 40, on the same side where the wings 41 are located. In this way, the base wall 40*a* of the frame 40 can rest directly on the inner side 5*b* of the inner door panel 5, or in any case be parallel thereto, if between the two parts in question there a further element is interposed (for example, a flat gasket). In various preferential embodiments, the wings 41 rise from the top of the annular reinforcement edge 42, but they could rise directly from the base wall 40*a*.

In various embodiments, the annular edge 42 is substantially quadrangular, in particular substantially rectangular with rounded corners; preferably, the annular edge 42 is at least in part rounded or inclined towards the inside of the opening B. More in general, it is preferable for the edge 20 of the opening A of the inner door panel 5 and the edge 42 of the passage B of the frame 40 to have substantially similar perimetral profiles, or profiles at least in part close to one another, e.g., profiles such as to be able to couple or come into contact with one another at least in part, in particular in the case of a deformation of the edge 20 of the opening A.

In various embodiments, the edge 42 is shaped so as to present a series of ribbings or stiffening elements distributed along its perimeter. In the case exemplified in the figures, these stiffening elements are constituted by small portions 43 of the frame substantially deformed or drawn, which extend between the base wall 40*a* and the outside of the edge 42. Preferably, each element 43 is shaped so as to form at least one wall that is arched or at least partially curved and/or at least one wall comprising stretches inclined in opposite directions.

Figure 12:
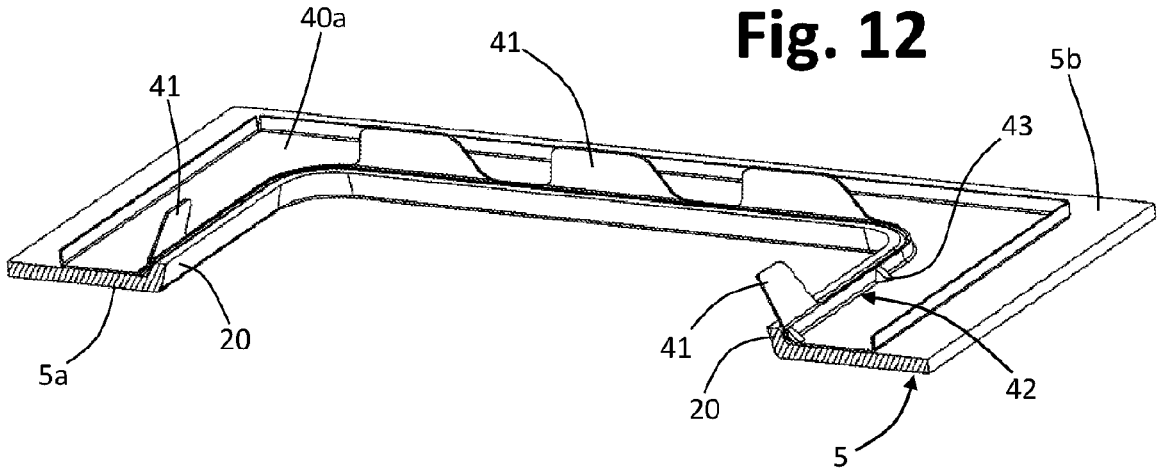
FIG. 12 is a sectioned view similar to that of FIG. 11.
Figure 13:
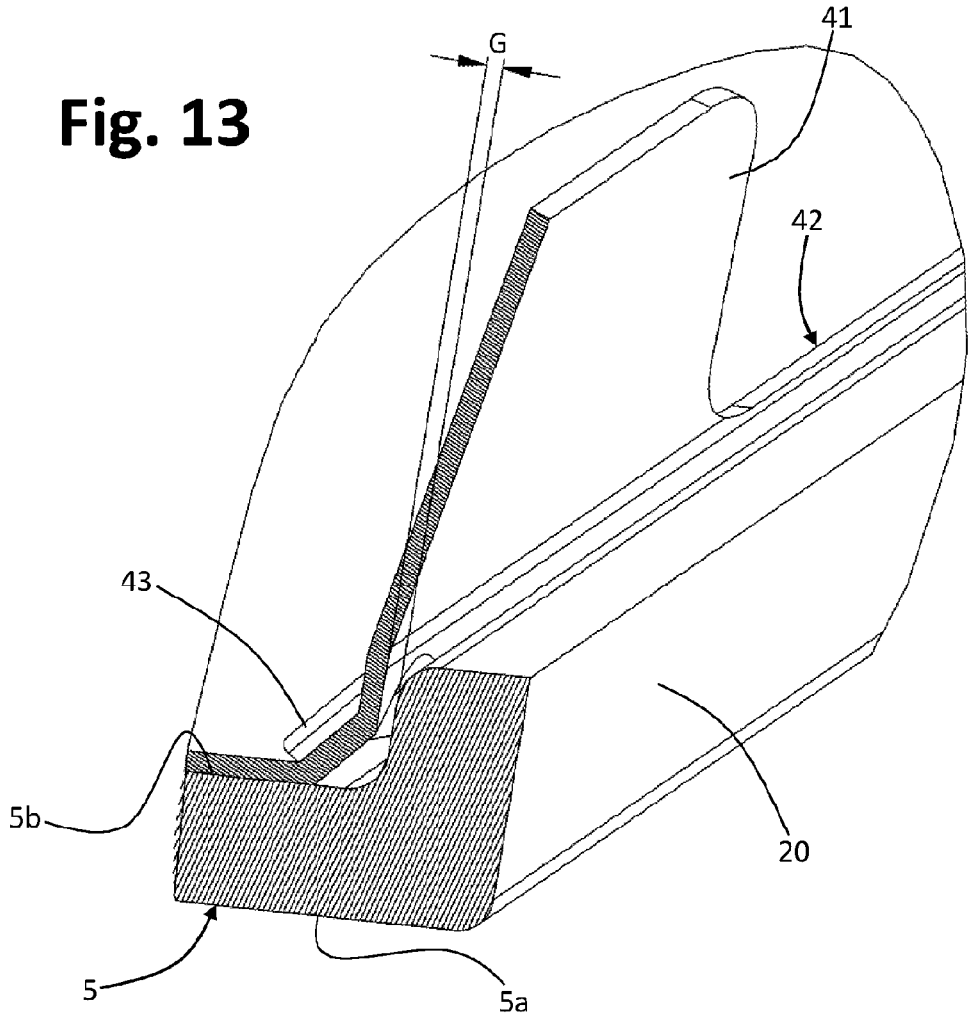
FIG. 13 is a detail at a larger scale of FIG. 12.

The annular reinforcement edge 42 preferentially has perimetral dimensions larger than those of the edge 20 so as to enable an easy but precise assembly of the frame 40 on the inner side 5*b* of the inner door panel 5, during fixing of the dispenser body 11. On the other hand, according to a preferential characteristic of the invention, the perimetral dimensions of the edges 20 and 42 are such that, when the body 11 is blocked in position via the frame 40, the edge 42 remains in any case at a distance from the edge 20, at the inner side 5*b* of the inner door panel 5. This characteristic may be appreciated, for example, in FIGS. 11-12, and in the corresponding detail of FIG. 13, the distance or gap existing between the two edges 20 and 42 being designated by G in FIG. 13. Merely by way of indication, this gap G may be smaller than 1 mm, for example 0.3 mm. Preferentially, the gap G extends along all the sides of the edges 20 and 42; i.e., the edges 20 and 42 are set substantially concentric, with an annular gap G in between.

Figure 14:
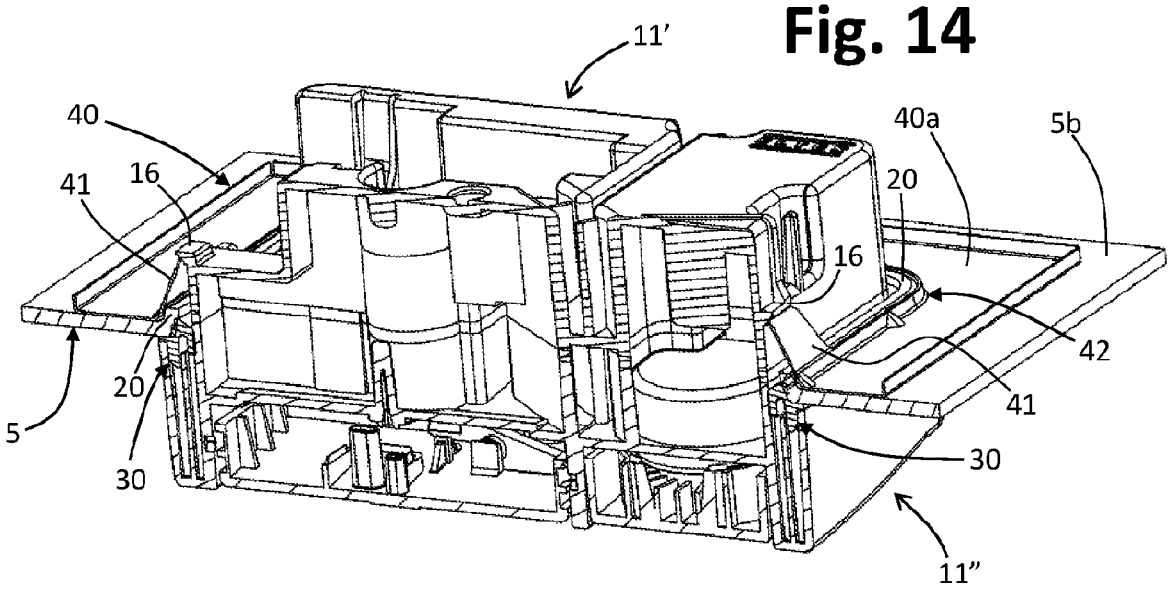
FIG. 14 is a sectioned view similar to that of FIG. 9.
Figure 15:
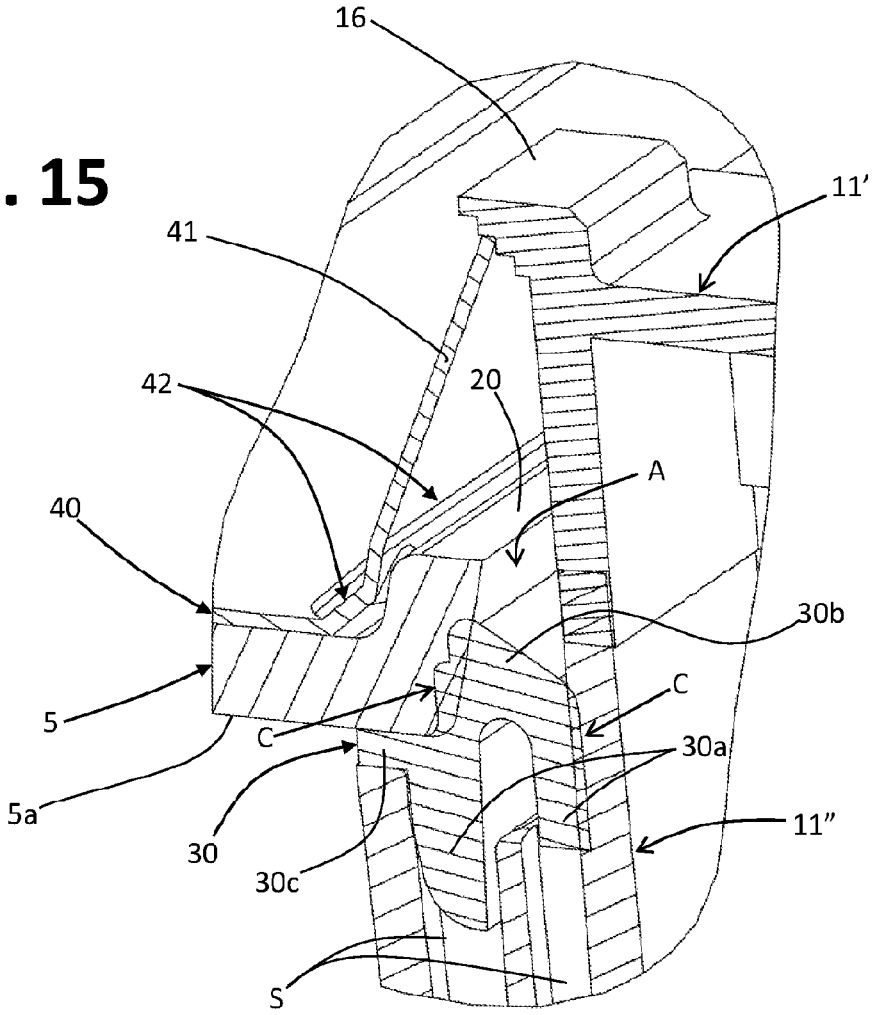
FIG. 15 is a detail at a larger scale of FIG. 14.
Figure 16:
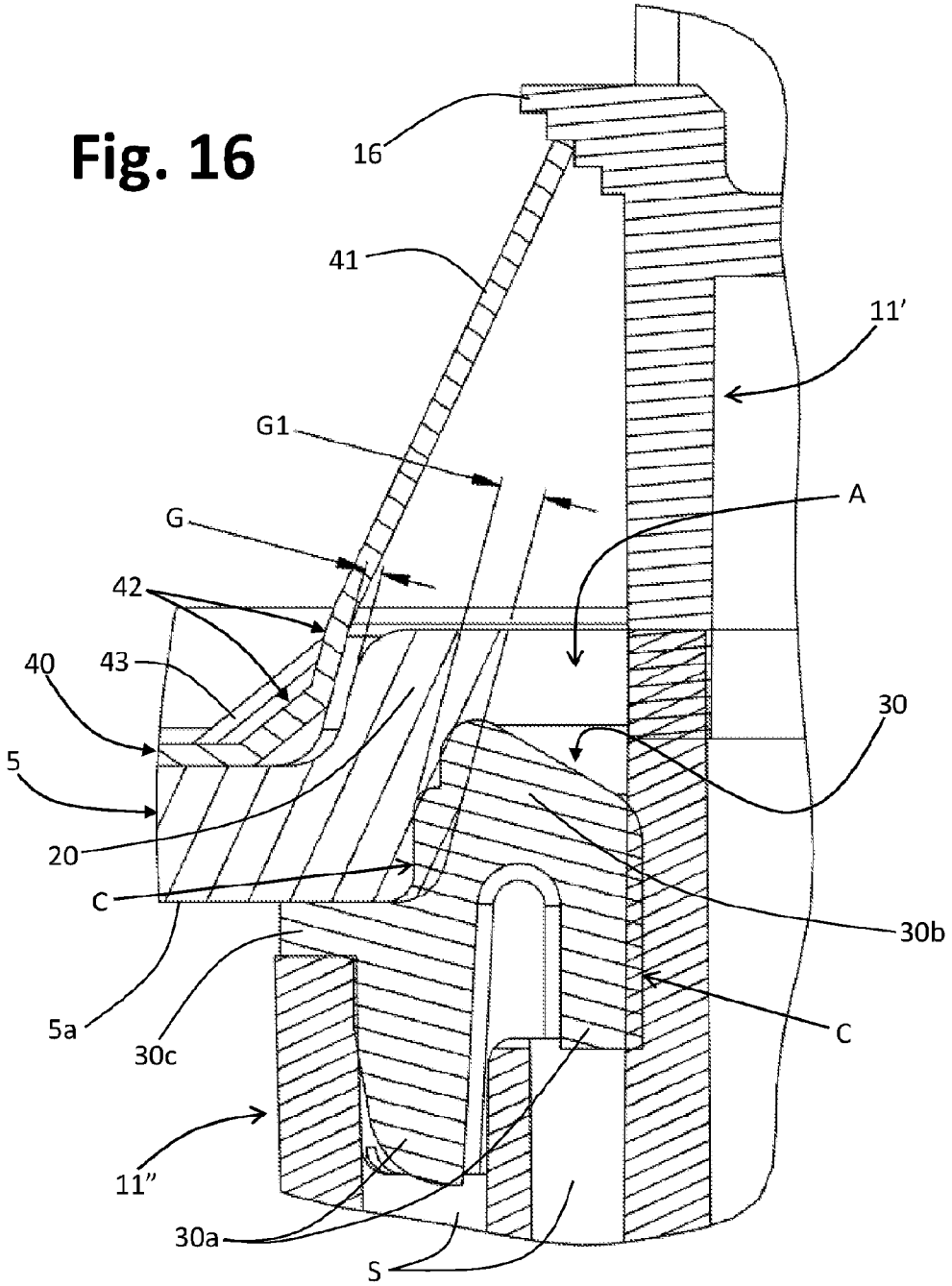
FIG. 16 is a lateral sectional view similar to that of FIG. 15.

As explained previously, mounted between the outer or mounting side 5*a* of the inner door panel 5 and the dispenser body 11, especially its front part 11", is an annular gasket 30, visible in its mounted condition in FIG. 14 and more clearly in the enlarged details of FIGS. 15 and 16.

According to a preferential characteristic of the invention, the gasket 30 is provided so as to have at least one respective part that is able to exert an action of radial seal between the edge 20 of the opening A and the dispenser body 11.

As has been said, the front part 11" of the body 11 preferably has perimetral dimensions greater both than the opening A of the inner door panel 5 and than the rear part 11' of the body 11. In this way, as may be seen in FIGS. 15 and 16, substantially in the proximity of the transition or join between the two body parts 11' and 11", the front part 11" may define the seat S, within which the corresponding foot portion 30*a* of the gasket 30 can be coupled. On the opposite side, the head portion 30*b* of the gasket 30 is, instead, shaped to engage—with at least a slight compression thereof—at least in part between the edge 20 of the opening A and the dispenser body 11, in particular the part 11" of the latter, so as to exert a substantially radial sealing action between the edge 20 and the body 11.

In this regard, it should be noted that the join between the two body parts 11' and 11" could be located in another position, and that at least part of the gasket 30—such as the head portion 30*b*—could engage at least in part between the edge 20 of the opening A and the part 11' of the dispenser body 11 (for example, according to what has been described in EP 1059058 A filed in the name of the present applicant).

It should be noted that in FIGS. 15 and 16 (and also in FIGS. 21 and 22) the gasket 30 is represented schematically in its non-elastically compressed form, and hence with some of its portions—designated by C—that are represented purposely as being superimposed to corresponding parts of the dispenser body 11: these portions C represent portions subjected to greater compression and/or elastic deformation at the edge 20, on one side, and at the body 11, on the other side, in order to provide or improve the aforesaid radial seal.

As has been said, in various preferential embodiments, the gasket 30 may be shaped so as to exert also a sealing action of an axial type. In the example illustrated, the gasket 30 comprises for this purpose the intermediate portion 30*c*, which is configured so as to be set—with at least slight compression thereof—between the body 11 (in particular, the part 11" in the example represented) and the outer side 5*a* of the inner door panel 5, in order to guarantee further the sealing effect and prevent any possible passage of water towards the inside of the door 4. Preferentially, the aforesaid intermediate portion 30*c* is configured like a flange or lip that projects laterally from the annular gasket 30, i.e., towards the outside thereof.

As mentioned previously, in various embodiments, the edge 42 of the central passage B of the frame 40 has perimetral dimensions larger than those of the edge 20 of the through opening A of the inner door panel 5, preferably so that between the two edges in question there exists a gap G; as mentioned, this is advantageous during assembly to facilitate precise positioning of the frame 40 at the opening A in the inner door panel 5. The presence of a predefined gap G could also be useful for compensating for possible dimensional tolerances of the edge 42 of the frame 40 and/or of the edge 20 of the inner door panel 5, such as possible dimensional tolerances deriving from a production process of stamping and/or blanking, for example, in the case of an edge 42 and/or a passage B slightly narrower than the nominal design value and/or in the case of an edge 20 and/or an opening A slightly wider than the nominal design value.

As mentioned in the introductory part, in use of the dish-washing machine 1 the inner door panel 5 made of plastic could occasionally be subject to deformations or expansions, in particular during steps of an operating cycle of the dishwasher that involve heating, such as washing steps or rinsing steps carried out with heated liquid inside the tub 3. The aforesaid deformations or expansions could hence cause risks of loss of tightness by the perimetral gasket 30, for example on account of displacements of the perimetral edge 20 of the opening A also under the force of elastic reaction of the annular gasket 30, which tends elastically to assume its expanded (non-compressed) condition. The frame 40 enables these risks to be avoided in so far as the presence of its edge 42 makes it possible to counter any yielding or excessive expansions of the inner door panel 5 in its seal area, and especially at its edge 20. In particular, it will be appreciated that any possible expansion or lateral yielding of the edge 20 will be stopped by the edge 42, when the former comes into contact with the latter, thereby preventing any loss of tightness.

Preferably, the edge 42 has a higher mechanical resistance than the edge 20. In particular, the edge 42 has a mechanical resistance at least in a radial direction that is greater than the radial force possibly exerted by the edge 20, substantially in the direction of the edge 42 and/or from the centre of the corresponding passage B towards the outside, in the case of expansion of the inner door panel 5.

To clarify the concept more fully, and with reference to FIG. 16, assume that the gap G present between the edge 20 and the edge 42 is approximately 0.3 mm, and that the gasket 30 is sized in the design stage so that it is subjected, when the dispenser 10 is installed, to a nominal compression, in the condition of sealing with respect to the edge 20, of approximately 0.8 mm, as highlighted by the distance G1 in FIG. 16.

The larger perimetral dimensions of the edge 32 as compared to the edge 20, i.e., the dimensional difference G, enable, as has been said, easy and correct positioning of the frame 30 during assembly. On the other hand, in the case of expansion of the plastic inner door panel 5, as mentioned above, the possible yielding of the edge 20 towards the left (as viewed in FIG. 16) will be stopped by the reinforcement edge 42, and will hence be limited to 0.3 mm at the most (i.e., until the edge 20 comes to rest on the edge 42): the degree of the compression of the gasket 30 is reduced, but remains in any case at a value (0.5 mm) such as to prevent risks of leakage through the opening A of the inner door panel 5.

As mentioned previously, in various preferential embodiments, the frame 40 is made of a single piece of metal material, preferably obtained via blanking and deformation of sheet metal. In other embodiments, however, the aforesaid frame may also be made of plastic material, preferably of a single piece, which can, for example, be obtained via injection moulding of thermoplastic material, possibly containing a filler (for example, with glass fibre).

Figure 17:
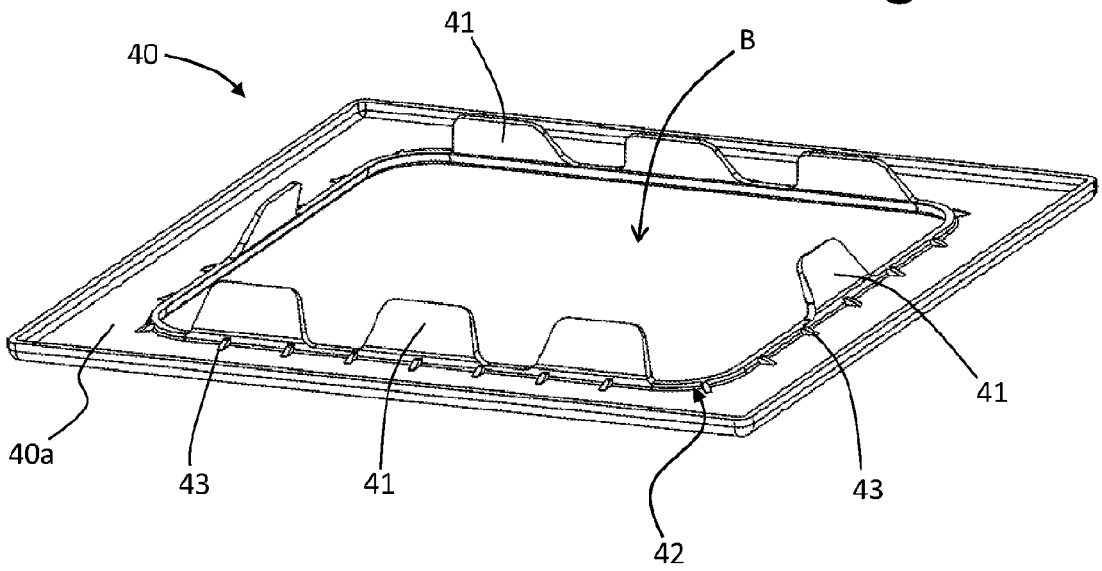
FIG. 17 is a schematic perspective view of a frame for a dispenser according to other possible embodiments of the invention.
Figure 18:
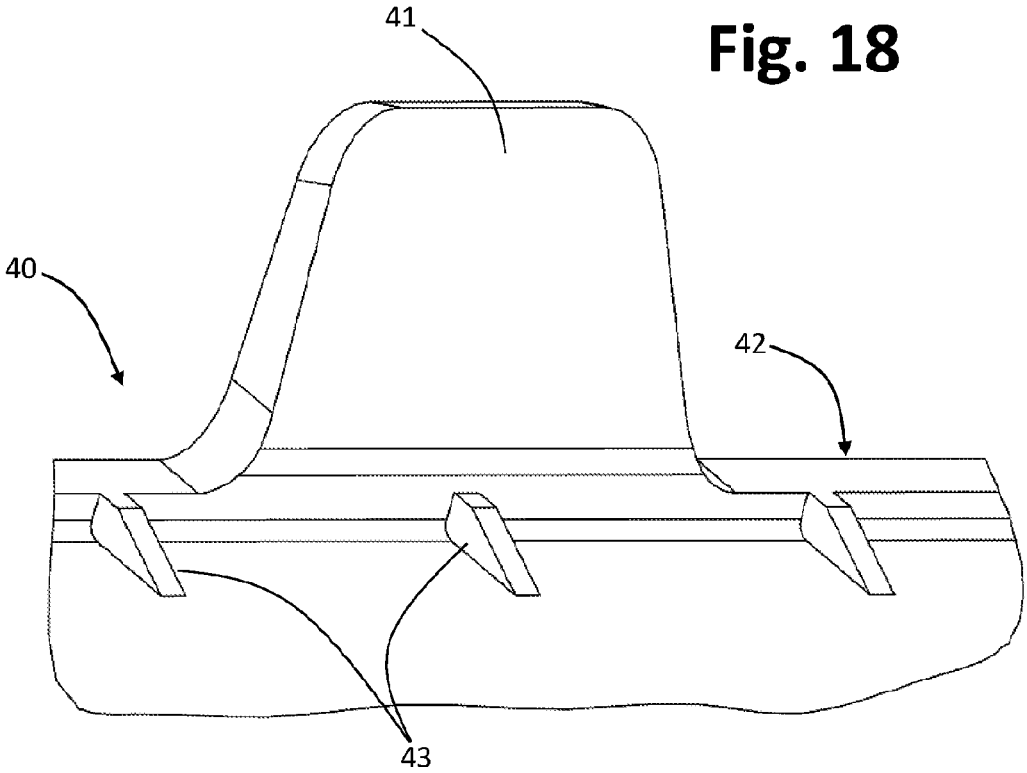
FIG. 18 is a detail at a larger scale of FIG. 17.

An embodiment of this sort is exemplified in FIGS. 17 and 18, where the same reference numbers as those of the previous figures are used to designate elements that are technically equivalent to the ones already described above. As may be noted, the frame 40 of FIG. 14 is structurally similar to that of FIG. 5, the most important difference being represented by the thicknesses of the various parts of the frame, which in the case where they are made of plastic material will preferentially be larger as compared to the case where they are made of metal. Another difference is constituted by the different way in which the stiffening elements 43 distributed along the perimeter of the edge 42 of the passage B are made, which in this case may in the form of full ribbings and be in a number larger than in the case of a metal frame 40. Also in this case the full formations represented by the elements 43 extend between the base wall 40*a* and the edge 42, evidently at the outer side of the latter in order to contribute to enhancing the function of reinforcement and containment proper of the edge 42.

In the polymer or plastic material that forms a frame of the type designated by 40 there may be at least partially embedded at least one metal reinforcement element or insert, such as an insert or ring made of metal wire located at least in part at the edge 42. On the at least one reinforcement element there can be overmoulded the polymer or plastic material: for example, a thermoplastic material can be injected in a mould where the at least one reinforcement element, for example having the shape of a metal insert or ring, has previously been inserted. Possibly, similar reinforcement elements could be provided at the wings 41, which, for example, are also at least partially embedded in an overmoulded polymer or plastic material.

In various embodiments, such as the ones described previously, the frame 40 performs both a function of fixing of the dispenser and a function of reinforcement of the tub wall (for example, the inner door panel) where the dispenser is installed. In other embodiments, however, the frame 40 could perform just one of the two functions referred to, or else the two functions could be separate and provided by different functional elements.

Figure 19:
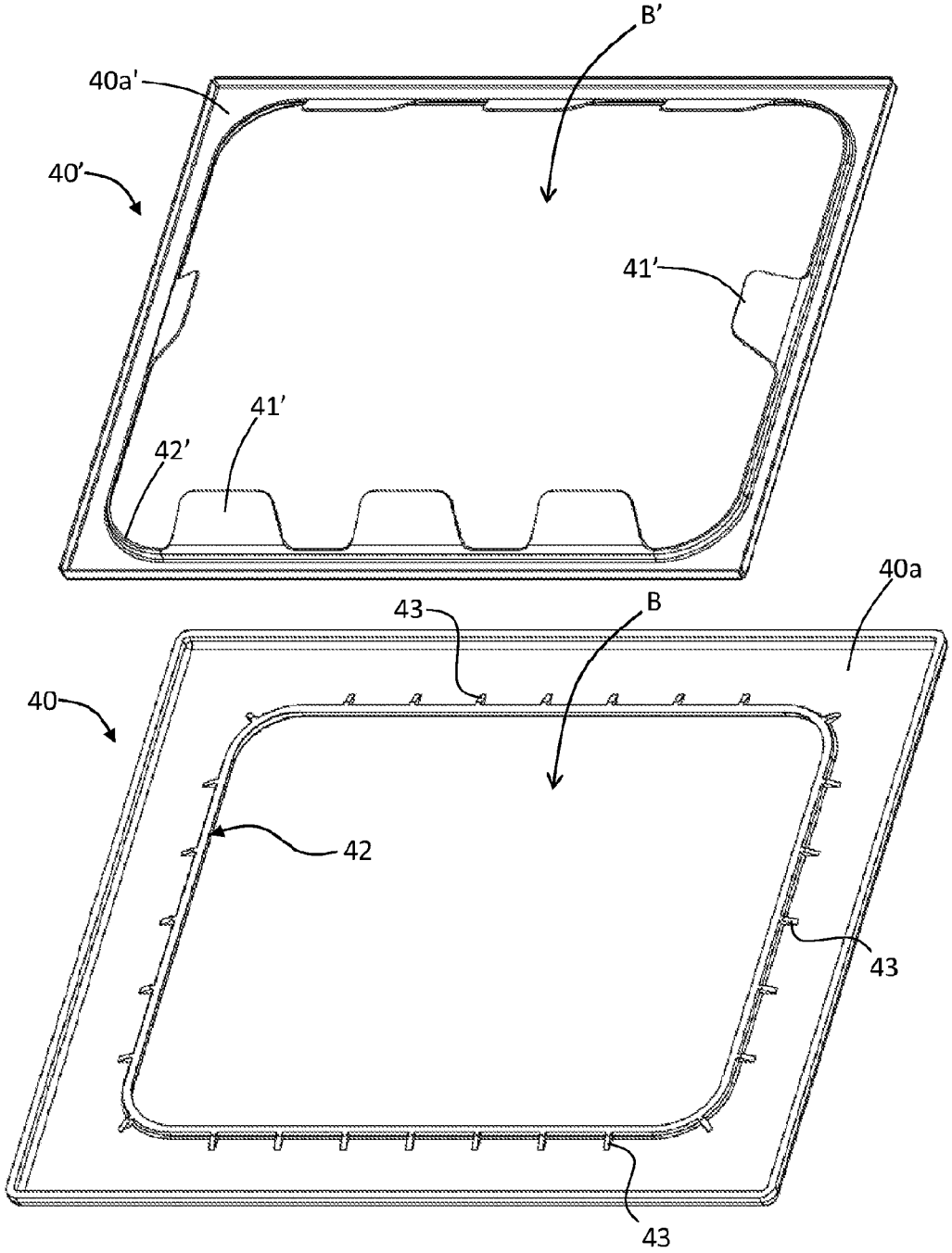
FIG. 19 is a schematic perspective view of a frame for a dispenser according to other possible embodiments of the invention, with a corresponding counter-frame.

For instance, FIG. 19 illustrates schematically a frame 40 that is configured for performing just functions of reinforcement of a wall of the tub where the dispenser is mounted, for example the inner door panel 5. Also in this example, the frame 40 is provided with the edge or lip 42, which rises from the base wall 40*a* and girds the passage B peripherally. Preferentially, the reinforcement elements or ribbings 43 are also provided, according to what has been described previously.

In various embodiments of this sort, the function of fixing of the dispenser and the frame 40 itself in position can be obtained by way of a further fixing frame, here designated by 40', and hereinafter referred to for simplicity as "counterframe". In the case exemplified, also the counterframe 40' has a generally annular shape, in particular quadrangular, with a respective base wall 42*a*' provided with a central passage B', having a shape generally similar to that of the passage B of the frame 40.

The counterframe 40' is provided with respective coupling means, for example in the form of wings 41' similar to the ones previously designated by 41, which rise or project from the back of the counterframe 40', or from the back of its base wall 40*a*', and are substantially distributed along the perimeter of the corresponding central passage B'. Also in this case, the wings 41' are preferentially at least slightly inclined towards the centre of the passage B' and are elastically flexible. Possibly, the counterframe 40' can also be provided with an edge or lip 42' that rises from the back of the corresponding base wall 40*a*' and girds the passage B'; in such a case, the wings 41' can rise from the edge 42'.

The frame 40 and the corresponding counterframe 41 may be both made of metal or else both made of plastic material, or at least in part of metal and at least in part of plastic, or again one of them may be made of metal and the other of plastic material: in the example represented, the frame 40 is made of plastic material and the counterframe 40' is made of metal material.

Preferentially, but not necessarily, the area of the base wall 40*a*' of the counterframe 40' is smaller than the area of the base wall 40*a* of the frame 40, whereas the perimeter of the edge 42' is greater than the perimeter of the edge 42, in any case in such a way that the frame and the counterframe can be set on top of one another, possibly at least in part coupled to one another or fitting into one another or engaged with one another. More in general, it is sufficient for the frame and the counterframe to be provided in such a way that the front of the base wall 42*a*' of the counterframe 40' is able to rest (either directly or indirectly) on the back of the base wall 40*a* of the frame 40.

Figure 20:
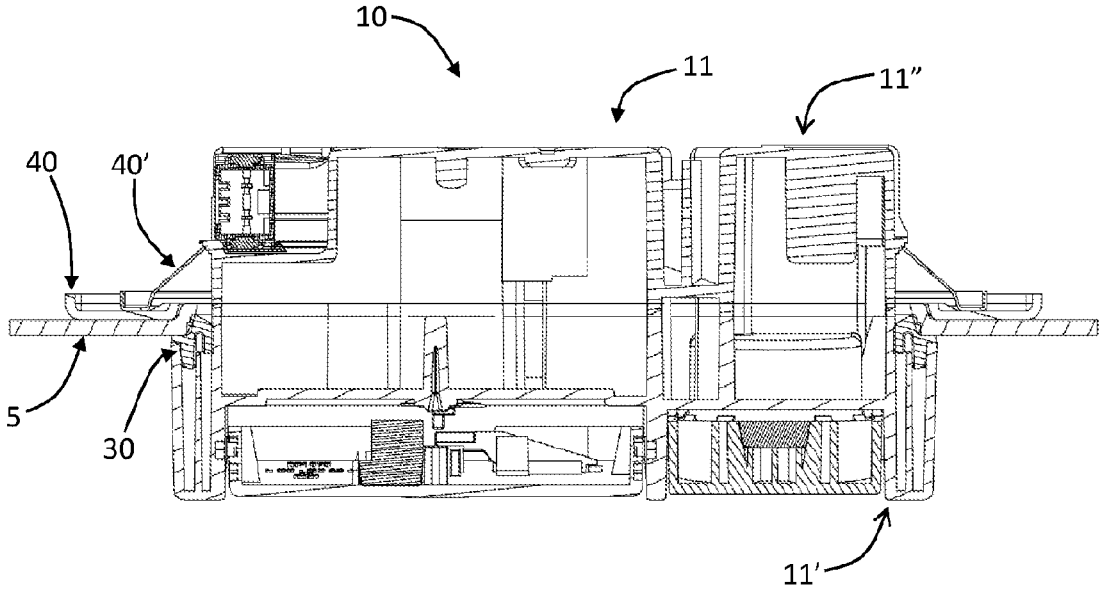
FIG. 20 is a schematic cross-sectional view of a dispenser according to possible embodiments of the invention, mounted on a wall of the washtub of a dishwasher using the frame and counter-frame of FIG. 18.
Figure 21:
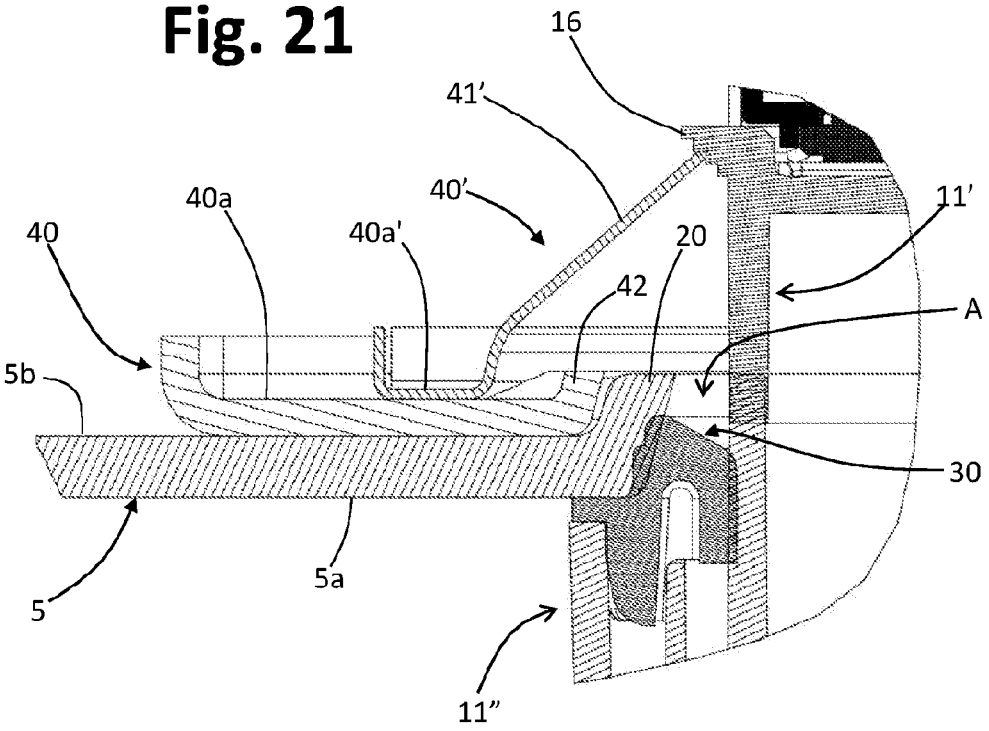
FIG. 21 is a detail at a larger scale of FIG. 20.

FIG. 20 and the corresponding detail of FIG. 21 illustrate a dispenser 10 in the mounted condition, where the frame 40 and the counterframe 40' of FIG. 19 are used, on a tub wall of the type previously designated by 5, for example an inner door panel of the dishwasher.

In a possible sequence of assembly, the part 11' of the dispenser body 11 is inserted through the opening A of the inner door panel 5, with the frame 40 that is set at the inner side 5*b* of the inner door panel, in particular with the base wall 40*a* of the frame 40 resting on the side 5*b*; in this step, the counterframe 40' can already be set concentrically with respect to the frame 40, or with its wall 40*a*' resting on the wall 40*a*, so that the passages B and B' (FIG. 19) are aligned. In this condition, the reinforcement edge 42 of the frame 40 girds the edge 20 of the opening A of the inner door panel 5, as already described previously.

Also in this case, in the course of insertion of the dispenser body 11 through the opening A, the wings 41' of the counterframe 40' come to rest on the engagement reliefs 16, bending elastically outwards (with respect to the passages B and B') and then elastically returning inwards as far as the engagement position. The upper ends of the wings 41' then pass beyond the profile of the engagement reliefs 16, again bending inwards (with respect to the passages B and B'), substantially engaging by snap-action with the reliefs themselves, as may be clearly noted in FIG. 21, thereby blocking the dispenser body 11 in position, preferably in a condition of partial compression of the gasket 30, which is at least in part set between the inner door panel 5 (in particular at least its edge 20) and the dispenser body 11.

Also in embodiments of this sort, then, the frame 40 integrates reinforcement means, represented by the edge 42, which are provided for countering any possible deformation or yielding of the inner door panel 5, at least in the area thereof that surrounds the corresponding through opening A designed for installation of the dispenser, in particular at the edge 20.

In embodiments of the type described with reference to FIGS. 19-21, the counterframe 40' makes it possible to obtain fixing in position both of the dispenser body 11 and of the reinforcement frame 40.

The presence of the counterframe 40' does not, however, constitute an essential characteristic, in so far as the functions of fixing of the dispenser could be obtained in a different way, for example by appropriately designing the dispenser body 11 for the purpose.

An example of this sort is illustrated schematically in FIG. 22, via a schematic detail in cross-sectional view similar to that of FIG. 21. In this case, the dispenser body 11, and preferably its rear part 11', itself integrates engagement means, which are able to co-operate with the reinforcement frame 40 in order to ensure positioning of the latter and of the dispenser. The reinforcement frame 40 of FIG. 22 may be built in a way similar to what is illustrated in FIG. 19.

In greater detail, in the non-limiting example of FIG. 22, the engagement means provided on the dispenser body 11 comprise elastic wings 16', which rise from the rear part 11' of the dispenser body 11 and extend towards the front part 11", being inclined outwards. The wings 16' have a length and inclination such that their distal end 16*a* is designed to rest on the frame 40 in order to keep it in position. In the non-limiting example represented, the elastic wings 16' are shown schematically as part of the dispenser body 11, but alternatively engagement means or wings 16' could be provided, configured as distinct parts, i.e., produced separately and then mounted on the dispenser body.

In a possible sequence of assembly, the part 11' of the dispenser body 11 is inserted through the opening A of the inner door panel 5, with the frame 40 that is set at the inner side 5*b* of the inner door panel so that the reinforcement edge—designated in FIG. 22 by 42"—girds the edge 20 of the opening A of the inner door panel 5. In the course of insertion of the dispenser body 11 through the opening A, the wings 16' of the dispenser come into contact with the edge 20, bending elastically inwards (i.e., towards the body 11) and then returning elastically outwards as they overcome the edge 20 itself. When the distal ends 16*a* of the wings 16 pass beyond the upper profile of the edge 20, the wings 16' again bend elastically outwards, coming into contact with the edge 42" of the frame 40, and then sliding on its surface. As insertion proceeds, once the wings 16' have passed beyond the upper profile of the edge 42", they are released, returning into their non-bent condition and coming to bear substantially upon the aforesaid upper profile of the edge 42", as may be noted in FIG. 22, thereby blocking the dispenser body 11 in position, at the same time holding the frame 40 in position. Also in this case, engagement occurs preferentially in a condition of partial compression of the gasket 30, which is at least in part interposed between the inner door panel 5 (in particular at least its edge 20) and the dispenser body 11. Possibly, in order to improve coupling, the upper profile of the edge 42" can be provided with a recess or seat for receiving the ends 16*a* of the wings 16', with a substantially snap-action engagement: hence, in a case of this sort, it is the edge 42" itself that provides a coupling means used for fixing the frame 40 and the dispenser body 11 in position. As may, however, be noted, also in embodiments of this sort, the frame 40 integrates reinforcement means, represented by the edge 42", designed to counter any possible deformations or failures of the edge 20.

From the foregoing, description the characteristics of the present invention emerge clearly, as likewise do its advantages. The fixing system described for the dispenser is simple to produced and easy, fast, and precise to assemble, at the same time guaranteeing a reliable seal and a proper positioning of the dispenser itself with respect to the mounting wall, in particular a wall made at least in part of a plastic or polymeric material. The reinforcement system described guarantees a reliable seal of the dispenser with respect to the mounting wall, thanks to the capacity of the frame described to counter any possible deformation or yielding of the aforesaid wall at least in its area that circumscribes the corresponding mounting through opening for the dispenser. The annular shape of the frame according to the invention makes it possible to obtain a better or more reliable fixing, preventing possible slackening or failure of the elastic wings that engage on the dispenser body and/or to strengthen the structure and/or improve tightness.

It is clear that numerous variations may be made by the person skilled in the art to the dispenser described herein by way of example and to the corresponding method of assembly, without thereby departing from the scope of the invention as defined in the ensuing claims.

In the embodiments described previously, the mounting side of the dispenser body on the corresponding tub wall 5 is the outer side 5*a*. However, the mounting side could be the inner side of the tub wall, or the dispenser body 11 could be configured for being mounted starting from the inner side 5*b* of the wall 5 or 5' of the tub 3, in which case it will preferentially have a rear part 11' with perimetral dimensions larger than the front part 11". In such a case, the edge 20 of the opening A of the wall 5 or 5' could face the inside of the washtub, with the fixing and/or reinforcement frame mounted on the outer side 5*a* of the wall, and hence directly facing the tub. For such a case, as exemplified schematically in FIG. 23, the aforesaid frame 40 will be preferably styled so as to provide a sort of frame in view that surrounds the front part 11" of the dispenser body 10. Possibly, the frame 40 may be provided with a corresponding part 44 that is designed to hide the means used for fixing the dispenser body and the frame in position to the wall 5. In embodiments where the edge 20 of the opening A faces the inside of the tub 3 and the dispenser body 11 is mounted starting from the inner side of the tub wall 5 or 5' (i.e., the side opposite to the side 5*a*), the perimetral sealing gasket could operate in a fluid-tight way only on the aforesaid inner side.

The invention claimed is:

1. A washing-agent dispenser, designed for being mounted at a through opening of a wall of a tub of a dishwasher, the dispenser comprising:

a dispenser body, having a rear part and a front part;

a perimetral gasket mounted in a corresponding seat of the dispenser body, the perimetral gasket being prearranged for exerting a sealing action with respect to a side of said wall;

a frame having a substantially annular shape, which defines a central passage through which one of the rear part and the front part of the dispenser body can be inserted, the frame having at least one of the following:

first coupling means, coupleable to corresponding second coupling means provided in the dispenser body, in particular in its rear part, the first coupling means and the second coupling means being configured for fixing of the dispenser body at the through opening of said wall in a condition of at least partial compression of the perimetral gasket for exerting thereby a sealing action between the dispenser body and the aforesaid side of said wall; and reinforcement means, prearranged for countering possible deformations or failures of said wall at least at an area thereof that circumscribes the corresponding through opening.

2. The dispenser according to claim 1, wherein the reinforcement means comprise a projecting annular edge that delimits the central passage of the frame.

3. The dispenser according to claim 1, wherein the perimetral gasket has at least one part configured for exerting a substantially radial sealing action of a between the dispenser body and a perimetral edge of the through opening of said wall.

4. The dispenser according to claim 1, wherein the frame is configured for being set at one of an outer side and an inner side of said wall, for fixing in position the dispenser body relative to said wall via a substantially elastic or snap-action coupling between the first coupling means and the second coupling means.

5. The dispenser according to claim 1, wherein the perimetral gasket has at least one part configured for exerting a substantially axial sealing action between the dispenser body and the outer side of said wall.

6. The dispenser according to claim 1, wherein the frame has a substantially plane base wall, which is designed to rest with respect to a mounting side of said wall of the tub.

7. The dispenser according to claim 6, wherein a projecting annular edge rises from the base wall, the projecting annular edge delimiting the central passage of the frame.

8. The dispenser according to claim 1, wherein the first coupling means comprise elastically flexible wings substantially distributed along a perimeter of the central passage of the frame, the elastically flexible wings being engageable in corresponding engagement reliefs that are defined in the rear part of the dispenser body and that form said second coupling means.

9. The dispenser according to claim 1, wherein the frame with the corresponding first coupling means and/or reinforcement means is made of a single piece.

10. The dispenser according to claim 1, wherein the frame comprises said reinforcement means, and wherein the dispenser further comprises a counterframe provided with respective first coupling means coupleable with corresponding second coupling means provided in the dispenser body, the first coupling means and the second coupling means being configured for fixing of the frame and the dispenser body at the through opening of said wall of the tub.

11. The dispenser according to claim 1, wherein the frame comprises said reinforcement means, and wherein the dispenser body further comprises coupling means coupleable with the frame and configured for fixing of the frame and the dispenser body at the through opening of said wall of the tub.

12. A dish-washing machine, having a washtub delimited by a plurality of tub walls, at least one of said tub walls being made at least partially of plastic material, said at least one tub wall defining a through opening at which a washing-agent dispenser according to claim 1 is mounted.

13. A fixing and/or reinforcement frame for a washing-agent dispenser according to claim 1.

14. A system for fixing a washing-agent dispenser to a tub wall of a washtub of a dish-washing machine, comprising a frame according to claim 1.

15. The dispenser according to claim 1, wherein the front part has perimetral dimensions greater than those of the rear part.

16. The dispenser according to claim 1, wherein the perimetral gasket is mounted in a corresponding seat of the dispenser body substantially in a position corresponding to an area of transition between the rear part and the front part.

17. A method for mounting a washing-agent dispenser in a dishwashing machine that comprises a washtub and a door, the method comprising the steps of:

i) providing, in a first wall designed to delimit at least part of the washtub, a through opening having a perimetral edge;

ii) providing a dispenser body having a rear part and a front part;

iii) providing a perimetral gasket and mounting it on the dispenser body;

iv) partially inserting the dispenser body in the through opening, in such a way that the at least a portion of the rear part of the dispenser body projects at the rear from the first wall and at least one portion of the front part of the dispenser body projects at the front from the first wall;

v) providing a fixing and/or reinforcement frame, having a substantially annular shape and defining a central passage, through which one of the rear part and the front part of the dispenser body can be inserted;

vi) fixing in position the dispenser body relative to the first wall, wherein the fixing and/or reinforcement frame is set at of a front side and a rear side of the first wall in such a way that the dispenser body is fixed in position relative to the first wall in a fluid-tight condition;

wherein step i) comprises making the first wall of plastic material at least in a region thereof where the through opening is defined;

wherein step v) comprises providing the fixing and/or reinforcement frame with at least one of the following:

first coupling means, which can be coupled to corresponding second coupling means provided in the dispenser body; and reinforcement means configured for reinforcing the first wall at least at an area thereof that surrounds the corresponding through opening.

18. The method according to claim 17, wherein step iii) comprises shaping the perimetral gasket with a respective part capable to fit between a perimetral edge of the through opening of the first wall and the dispenser body, to obtain a substantially radial sealing action therebetween.

19. The method according to claim 17, wherein step v) comprises forming the central passage of the fixing and/or reinforcement frame with an annular reinforcement edge having perimetral dimensions larger than those of a perimetral edge of the through opening of the first wall, the annular reinforcement edge generally facing the perimetral edge of the through opening of the first wall.

20. The method according to claim 19, wherein step vi) comprises fixing in position the dispenser body with the annular reinforcement edge of the fixing and/or reinforcement frame that is set at a distance from the perimetral edge of the through opening of the first wall.

* * * * *